United States Patent [19]

Lex

[11] 4,295,240

[45] Oct. 20, 1981

[54] CLEANING DEVICE

[76] Inventor: Franz Lex, Annenstrasse 6, A 8020 Graz, Austria

[21] Appl. No.: 70,317

[22] Filed: Aug. 27, 1979

[30] Foreign Application Priority Data

Apr. 9, 1978 [AT] Austria ..... 6365/78

[51] Int. Cl.[3] ..... A46B 13/04

[52] U.S. Cl. ..... 15/22 R; 15/97 R; 51/170 MT; 128/36

[58] Field of Search ..... 15/22 R, 22 A, 97 R; 128/35, 36, 46, 49, 52; 51/170 TL, 170 MT; 310/50

[56] References Cited

U.S. PATENT DOCUMENTS

| | | | |
|---|---|---|---|
| 2,975,448 | 3/1961 | Glaser | 15/22 R |
| 3,967,617 | 7/1976 | Krolik | 128/36 |
| 3,968,789 | 7/1976 | Simoncini | 15/22 R |

FOREIGN PATENT DOCUMENTS

| | | | |
|---|---|---|---|
| 1914433 | 10/1970 | Fed. Rep. of Germany | 15/97 R |
| 2042140 | 3/1971 | Fed. Rep. of Germany . | |
| 1216838 | 11/1959 | France | 15/22 R |
| 1523413 | 3/1968 | France . | |
| 1603472 | 5/1971 | France . | |

*Primary Examiner*—Edward L. Roberts

[57] ABSTRACT

A cleaning device comprises a housing and a cleaning body. The cleaning body is mounted on a stub shaft which is glidingly arranged in a guide bore at one end of the housing and the guide bore and stub shaft extend in the working direction in which the cleaning body is pressed against an object to be cleaned. A driving system for driving the stub shaft and the cleaning body mounted thereon in an oscillatory manner includes a drive motor, a shaft axially extending from one of the motor ends, a flywheel mass mounted on the motor shaft for generating an oscillatory motion, a connection for transmitting the oscillatory motion to the stub shaft and a resilient mounting for the drive motor in the housing.

5 Claims, 1 Drawing Figure

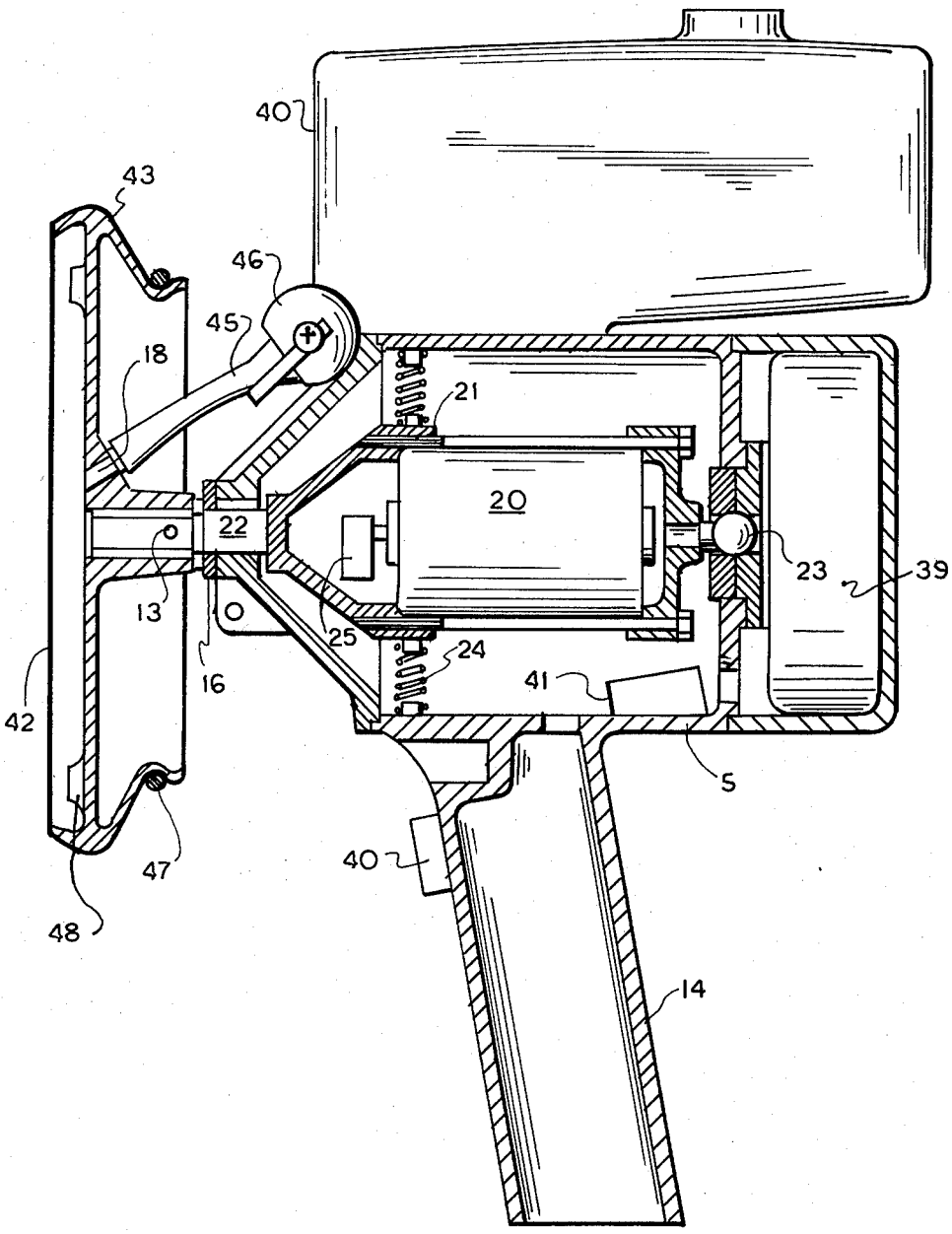
40
43
46
45
18
21
20
22
23
39
13
25
24
16
41
42
5
47
40
48
14

CLEANING DEVICE

The invention relates to a cleaning device, preferably formed as a hand-held device, comprising of a housing enclosing a drive motor with a driving system for a cleaning body driven essentially in an oscillatory manner.

Cleaning devices of this type have been known in various forms and are described, for example, in German Published Patent Application No. 2,042,140, French Pat. No. 1,603,472 and French Pat. No. 1,523,413.

The cleaning devices described in these publications have as a common characteristic a mechanical driving system for the oscillatory drive of the cleaning body, that is, the transmission of force from the shaft of the drive motor to the cleaning body is effected by means of a sprocket or worm gear drive through a crank drive or cam.

As disadvantage of all the mentioned cleaning devices must be mentioned not only the considerable expense for the driving system of the cleaning body but also the necessity of applying a lubricant to the moving parts and, therefore, of sealingly arranging them in the housing. Because of the mechanical force transmission, the drive motor and the mechanical driving system furthermore must be made strong enough to function without breaking when increased resistance is encountered, for instance when the contact pressure is great. This has the added disadvantage of increasing the weight and size of the apparatus.

It is the object of the invention to construct a cleaning device of the above-indicated type so that the cleaning effect may be obtained with substantially less expense, without the disadvantage of the known device.

This is accomplished according to the invention with a driving system constituted by a flywheel mass driven by the drive motor, the oscillations thereof being transmissible to the cleaning body by a drive part which is at least indirectly connected with the housing thereof.

According to a preferred embodiment of the invention, the flywheel mass is arranged on the shaft of the drive motor.

To prevent the oscillations of the driving system of the cleaning device, which has a housing which is at least partially formed as a handle grip, from being transmitted thereto, the drive motor may be arranged resiliently or oscillatingly in the housing of the apparatus according to a further feature of the invention. For this purpose, springs or rubber bolts may be used, for example. The oscillation of the cleaning body is primarily a circular movement because of the flywheel mass, the intensity of which may preferably be changed with the rotary speed thereof, for example by controlling the rotary speed of the motor or by a sprocket transmission, in which case the flywheel mass is mounted on the driven sprocket. The movement may be oriented parallel as well as perpendicularly to the object of cleaning, depending on the arrangement of the cleaning body in relation to the axis of the drive motor.

In particular cases, it is advantageous, for instance for the cleaning of Venetian blinds, to exert the oscillatory cleaning movement primarily rectilinearly and parallel to the surface of the object to be cleaned.

According to another feature of the invention, the drive part of the cleaning body is glidingly arranged in a preferably slit-shaped guide in the housing. This guide slit may be rectilinear, arcuate or sinuous, depending on the requirements.

According to a special embodiment of the invention, the drive motor is mounted in the housing on the drive side in an oscillatory manner while it is rotatably or pivotally mounted on the opposite side.

To make it possible to use cleaning bodies adapted for different cleaning purposes, it is advantageous according to another feature to construct the drive part for the replaceable reception of different cleaning bodies, preferably in the shape of a hexagonal bolt equipped with a retainer. Thus, various cleaning and polishing bodies may be applied in the simplest manner. However, this drive part may also be constructed in any desired form, for instance as a housing part. In a further development of the invention, the cleaning body may have a circumference of different forms and may be adapted to the surface of the object to be cleaned, for example curved.

Continuous cleaning can be assured if, according to another feature of the invention, a receptacle for holding a cleaning medium is associated therewith. In commercial equipment, it is useful to add a suction apparatus or a connection to such an apparatus.

BRIEF DESCRIPTION OF DRAWING

The invention is explained in connection with an examplary embodiment which is illustrated in the single FIGURE showing a longitudinal section of a cleaning device according to the invention for cleaning more or less plane surfaces and which comprises the essential features of the invention.

Drive motor 20 is arranged in housing 5 which is integral with handle grip 14. The two ends of drive motor 20 are held in cage 21, one of the motor ends being oscillatingly supported by diametrically opposed springs or rubber bolts 24 and the opposite end of the motor being rotatably or pivotally supported in the housing by ball joint 23. Flywheel mass 25, whose oscillations are transmitted to drive shaft 22 affixed to the cage holding drive motor 20, is affixed to the shaft of drive motor 20. The axial guide bore in the front cover of housing 5 receiving drive shaft 22 is sealed by gasket 16 and cage 21 has a cup-shaped extension surrounding flywheel mass 25. The front cover of housing 5 may be threadedly mounted thereon and defines a slit-shaped guide bore for drive shaft 22. Cleaning body 43, which is shown disc-shaped by way of example, is mounted on the hexagonally shaped drive shaft 22 and is held thereon by retainer 13. Cleaning body 43 is provided with a cleaning part 42 consisting of plastic foams, synthetic resin webs, fur skins, brushes and the like, which are affixed to body 43 by clamping ring 47 or by studs 48 or the like. A channel 18 in the cleaning body enables a cleaning or polishing medium and cleaning water, if desired, to be conducted from inlet conduit 45 connected by check valve 46 with receptacle 44 for cleaning medium, which may also be mounted in handle grip 14. An extension may also be mounted on handle grip 14. Drive motor 20, which may be operated by batteries 39, is actuated by switch 40. A charging device plug 41 enables the nickel-cadmium batteries to be re-charged. Of course, the drive motor for the cleaning device of the invention may also be actuated directly by electric network current or a low voltage transformer. The use of the device for the polishing of objects also is within the scope of the invention.

I claim:

1. A cleaning device comprising a housing having an axis and guide means at one end of the housing, a cleaning body to be pressed against an object to be cleaned in a working direction, a drive part glidingly arranged in the guide means, the cleaning body being mounted on the drive part and being driven thereby, and a driving system for driving the drive part and the cleaning body mounted thereon in an oscillatory manner, the driving system including a drive motor having an axis and two ends, a shaft axially extending from one one of the motor ends, a flywheel mass mounted on the motor shaft for generating an oscillatory motion, means for transmitting the oscillatory motion to the drive part, means mounting the drive motor in the housing for oscillation, the mounting means being arranged at one of the motor ends adjacent the drive part, and means for pivotally mounting the other end of the motor in the housing.

2. The cleaning device of claim 1, wherein the housing, the guide means and the motor are coaxial and extend in the working direction.

3. The cleaning device of claim 1 or 2, wherein the drive part is arranged for replaceably carrying the cleaning body, the drive part being a stub shaft having an end of hexagonal cross section for receiving a correspondingly shaped bore in the cleaning body, and further comprising retaining means for holding the cleaning body on the drive part.

4. The cleaning device of claim 1, further comprising a receptacle for cleaning fluid mounted on the housing and conduit means for conducting the cleaning fluid from the receptacle to the cleaning body.

5. The cleaning device of claim 1, further comprising a hand grip on the housing for enabling the cleaning device to be manually held and pressed against the object to be cleaned.

* * * * *